United States Patent [19]

Tallman

[11] 4,018,421

[45] Apr. 19, 1977

[54] PORTABLE LIFTING JACK

[76] Inventor: Erven Tallman, 15934 S. Figueroa, Gardena, Calif. 90247

[22] Filed: June 3, 1976

[21] Appl. No.: 692,289

Related U.S. Application Data

[63] Continuation of Ser. No. 540,121, Jan. 10, 1975, abandoned.

[52] U.S. Cl. ..... 254/8 B

[51] Int. Cl.² ..... B66F 5/04

[58] Field of Search ..... 254/2 B, 2 C, 8 B, 8 C, 254/9 B, 9 C, 10 B, 10 C

[56] References Cited

UNITED STATES PATENTS

| | | | |
|---|---|---|---|
| 1,951,398 | 3/1934 | Dearsley | 254/2 B |
| 2,264,979 | 12/1941 | Jackson | 254/8 B |
| 2,370,681 | 3/1945 | Mueller | 254/10 B |

FOREIGN PATENTS OR APPLICATIONS

| | | | |
|---|---|---|---|
| 521,141 | 1/1956 | Canada | 254/8 B |

*Primary Examiner*—Al Lawrence Smith
*Assistant Examiner*—Robert C. Watson

[57] ABSTRACT

A hydraulic lifting jack has a base supported on wheels, an elevating linkage, a hydraulic ram operating with the linkage and a handle for pressurizing and releasing the hydraulic ram. An integral block of rugged rectangular configuration serves a multiple purpose of providing a reservoir for hydraulic fluid, mounting the ram, mounting the pump and providing exteriorly precision drilled bores for all the hydraulic activity.

15 Claims, 9 Drawing Figures

PORTABLE LIFTING JACK

This is a continuation of copending application, Ser. No. 540,121 filed Jan. 10, 1975, now abandoned.

Low-slung hydraulic lifting jacks on wheels or casters, although adapted to a variety of uses, have been widely used under the axle of an automobile for lifting one or both wheels at one end of the automobile off the ground. Equipment of this kind heretofore has more commonly been of a character used in garages and service stations than by the individual car owner. Devices in the past have been large, heavy, and expensive. The general character of such low-slung jacks have, however, made them extremely useful and easily manipulatable in the hands of a mechanic when there is need to slide a jack under an automobile beneath an axle which is a considerable distance inward from overhanging portions of the chasis and vehicle body.

For the average car owner jacks currently available such as bumper jacks are usable only with a questionable degree of safety. Long shafts of one kind or another, relatively small in cross-sectional area, need to be capable of lifting a distance of 18 – 24 inches or more at the bumper in order to finally lift the wheel high enough off of the ground to permit removal of a tire. Similar types of jacks are customarily employed for the smaller or compact cars applied along the side of the frame so as to lift the entire side of the vehicle high enough to permit the removal of a tire. Brakes have to be carefully set, or the other wheels carefully blocked, in order to ensure any degree of safety when the operation needs to be done on the highway. If the automobile is on a slight up or downgrade the situation is even more perilous. The heavier jacks, initially mentioned, are much too heavy for the average car owner to lift into the trunk compartment and are far too long and bulky to be conveniently stored in such a location.

It is therefore among the objects of the invention to provide a new and improved portable low-slung hydraulic lifting jack which is small, compact, light in weight and which at the same time has sufficient lifting capacity to lift the end of virtually any passenger vehicle far enough off of the ground to comfortably remove and replace tires.

Another object of the invention is to provide a new and improved low-slung hydraulic lifting jack which has a sufficiently compact integrated design that overall dimensions of length and breadth can be kept to a minimum without curtailing the extent of the lift or the amount of weight which can be lifted.

Still another object of the invention is to provide a new and improved portable low-slung hydraulic lifting jack wherein working parts of the hydraulic assembly serve also as elements for construction of the frame itself whereby to reduce the number of parts involved and at the same time add to the ruggedness of construction to such an extent that the device can be made to sell at a price within the purchasing power of the average motor vehicle owner and which is also compact and light enough in weight to be carried as standard equipment in any passenger automobile regardless of size.

Further included among the objects of the invention is to provide a portable low-slung hydraulic lifting jacks of such character that the entire operation of the jack can be manipulated from the handle no matter how far it needs to be inserted under the vehicle where it can be pumped up to a desired lifting position, anchored in that position and then as readily released, all by manipulation of the outside end of the handle which extends clear of the vehicle body.

With these and other objects in view, the invention consists in the construction, arrangement, and combination of the various parts of the device, whereby the objects contemplated are attained, as hereinafter set forth, pointed out in the appended claims and illustrated in the accompanying drawings:

FIG. 6 is a fragmentary longitudinal sectional view similar to FIGS. 4 and 5, showing the position of parts when the jack is lowering;

Figure 1:
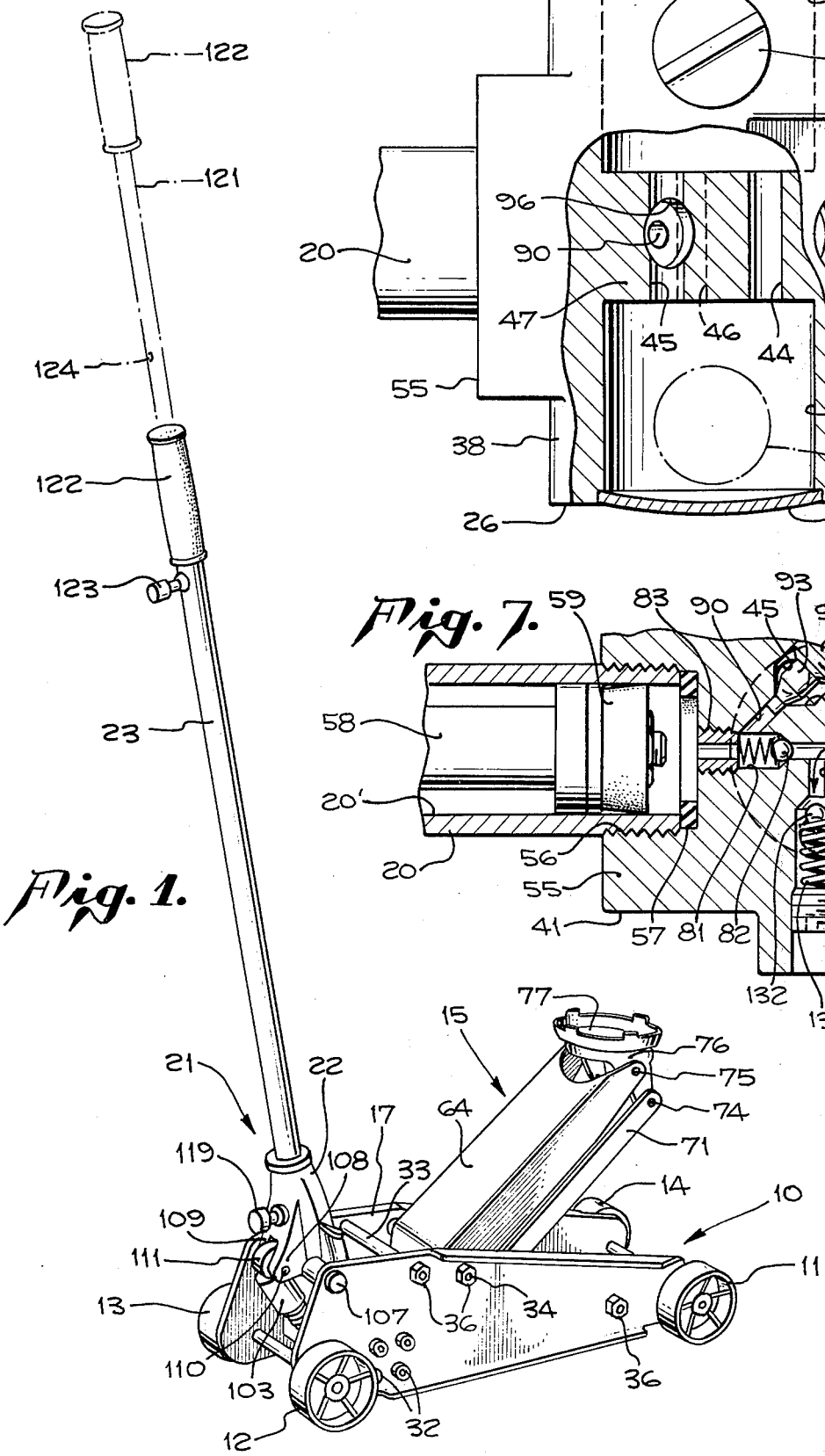
FIG. 1 is a side perspective view of the lifting jack in an elevated position.

In an embodiment of the invention chosen for purpose of illustration, and as generally appears in FIG. 1, there is shown a low-slung jack of the type hereunder consideration consisting of a frame or chassis indicated generally by the reference character 10 and carried by wheels 11, 12, 13 and 14. An elevator 15 is pivotally mounted on the frame for operation between opposite side plates 16 and 17. There is a hydraulic power unit consisting in part of the hydraulic cylinder 20, not visible in FIG. 1, although clearly shown in FIGS. 2 through 7, which is mounted between the side plates 16 and 17. The power unit is manipulated by a handle assembly 21 consisting in the main of a yoke 22 pivoted on the side plates 16 and 17, and an extendable shaft 23 serving as a handle.

Figure 8:
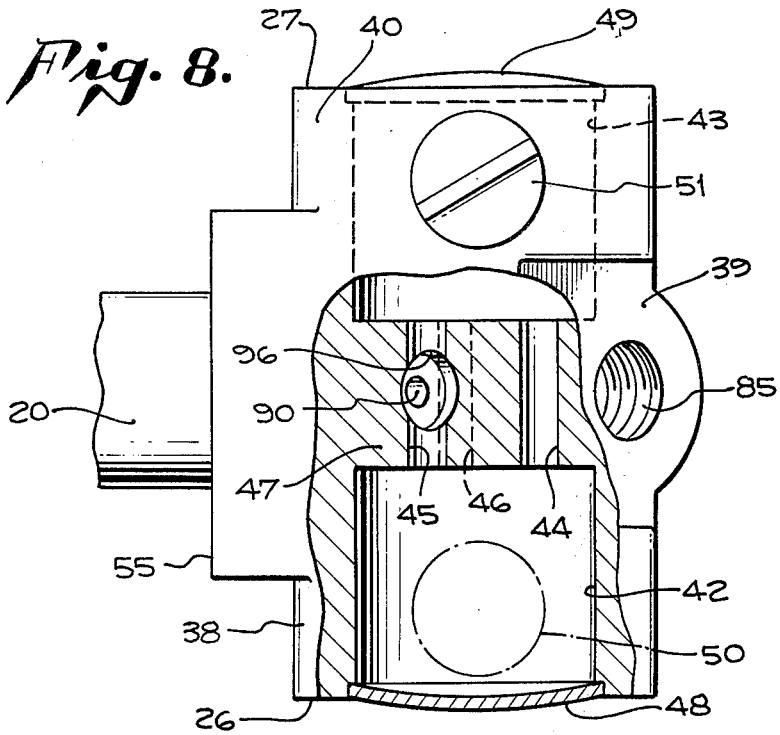
FIG. 8 is a plan view of the hydraulic reservoir block partially broken away.
Figure 2:
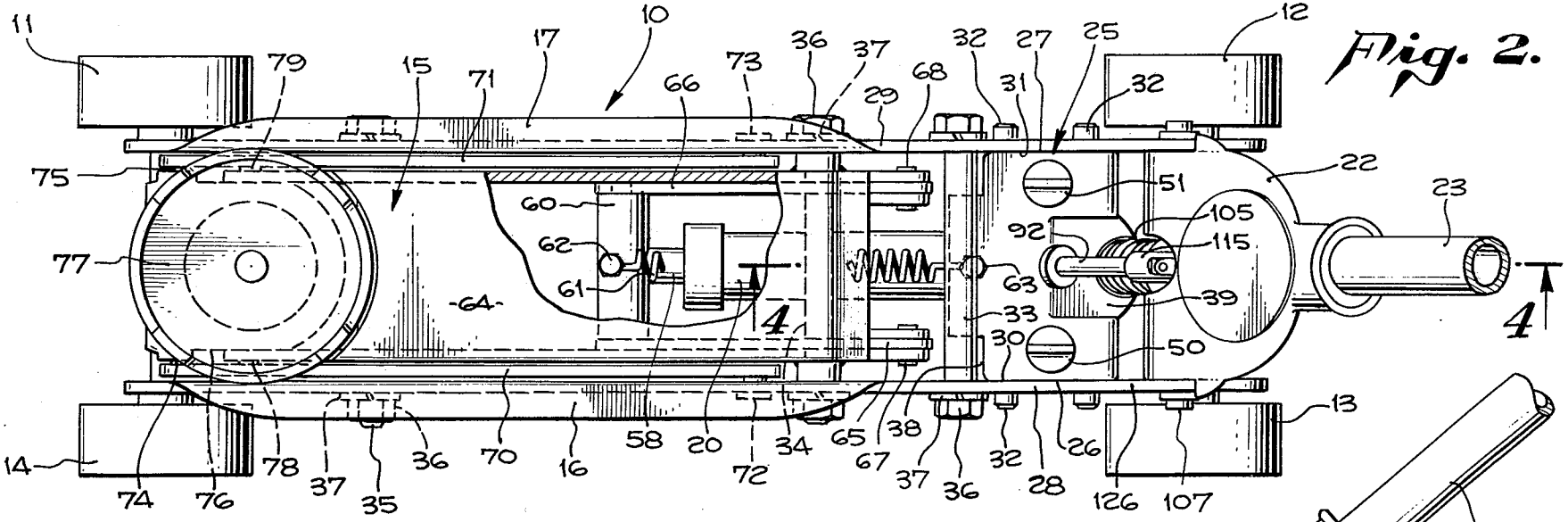
FIG. 2 is a plan view of the jack partially broken away.
Figure 3:
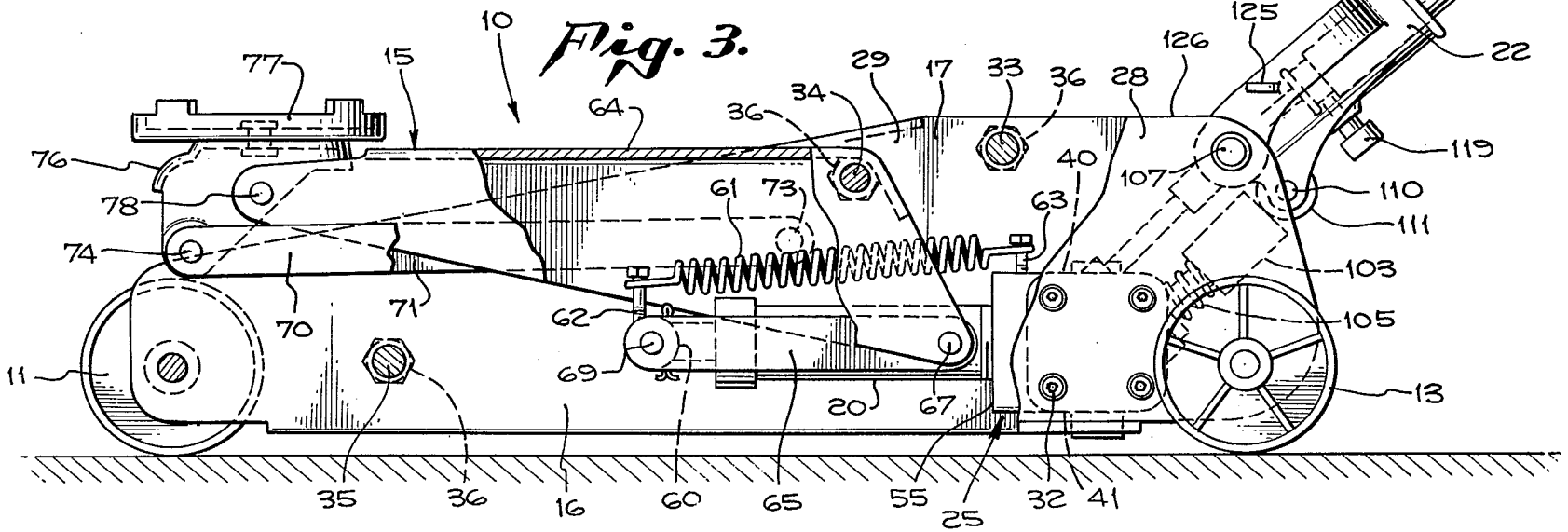
FIG. 3 is a side elevational view partially broken away and showing the jack in lowered position.

Reference is made to FIGS. 2 and 3 for the location of a multi-purpose block 25, FIGS. 4 through 7 for its internal construction and FIG. 8 for the exterior form.

The multi-purpose block 25 has opposite flat side walls 26 and 27 which engage respective side plates 28 and 29 of the frame 10 on the respective inside faces 30 and 31. In the chosen embodiment inside walls are substantially square in configuration and four bolts 32 extend through the side plate in each instance and into the block adjacent the corners of the respective side wall. In this fashion the block 25 serves as a spacer between the side plates and also as a rigid means of appreciable stability for holding the side plates in assembled relationship adjacent one end of the frame.

Elsewhere spanning the distance between the plates are spacers 33, 34 and 35 having threaded outer ends for attachment of nuts 36 applied over the lock washers.

Figure 9:
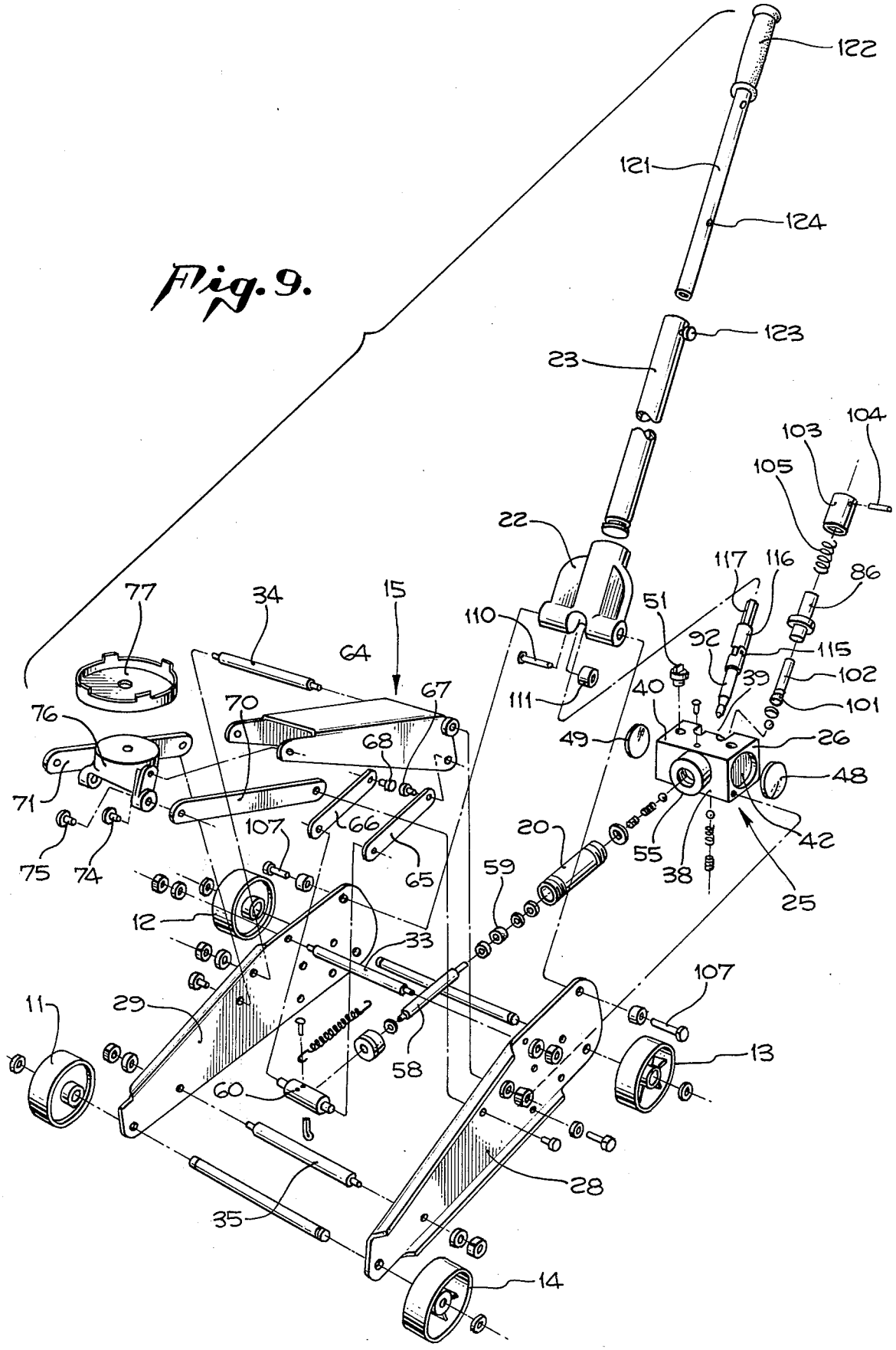
FIG. 9 is an exploded perspective view showing details of the device.

As shown in FIGS. 8 and 9, the block 25 has in addition to the side walls 26 and 27 a relatively flat inside end wall 38 and a relatively flat outside end surface 39, the inside end wall 38 extending vertically and the outside end surface 39 extending obliquely at a selected inclination commensurate with operation of the operating handle. There is also a relatively flat top wall 40 and a relatively flat bottom wall 41.

Within the multi-purpose block 25, as shown in FIG. 8, there is a reservoir for hydraulic fluid consisting mainly of chambers 42 and 43 interconnected by horizontal passages 44, 45, and 46. The passages extend through a relatively thick partition 47 which has mainly a structural function in addition to serving as a separation between the chambers 42 and 43. Discs on 48 and 49 at outer ends of the respective chambers 42 and 43 are shown in FIG. 8. For the chamber 42 there is a removable cap 50, and for the chamber 43 a removable cap 51 which when removed permit filling of the reservoir with hydraulic fluid. These caps are readily accessible from the top of the frame.

Protruding from the inside end wall 38 is a boss 55 provided with a threaded opening 56 in which is mounted the hydraulic cylinder 20. A washer 57 assures a sealed connection. A power cylinder is provided with a ram 58 on the left end of which is a piston head 59 as viewed in FIG. 7. The ram is connected to a trunnion 60, as shown in FIGS. 2 and 3. A spring 61 is attached at one end to the trunnion 60 by means of a bolt 62 and at the other end is attached to the upper side of the block 25 by means of a bolt 63. The spring is biased so as to return the ram and piston head to initial position when there is no pressure in the cylinder.

The ram acting through the trunnion serves to raise the elevator 15 which is of substantially conventional construction. The elevator consists in part of an elevator arm 64 pivotally carried by the side plates and also connected to the spacer 34. Trunnion arms 65 and 66 are connected to the elevator arm at the right end as viewed in FIGS. 2 and 3 by means of pivot pins 67 and 68. At the opposite or left-hand ends of the trunnion arms there is a pivot pin 69 common to both arms which extends pivotally to the trunnion 60.

Control arms 70 and 71 are connected at their right-hand ends as viewed in FIGS. 2 and 3 to the respective side plates 16 and 17 by means of pivot pins 72 and 73. At their left-hand ends the control arms are attached by means of pivot pins 74 and 75 respectively to a bracket 76, the bracket in turn supporting a lifting platform 77. The left-hand end of the elevator arm 64 is also attached to the same bracket 76 by means of pivot pins 78 and 79. As appears from the foregoing description when the ram 58 is extended, namely moving from right to left as viewed in FIGS. 2 and 3, the elevator is raised by lever action namely the trunnion arm 65 pulling on the pivot pins 67 and 68 and the resulting force tilting the elevator arm 64 angularly upward, meanwhile the control arms 70 and 71 force the bracket 76 and lifting platform 77 to remain horizontal as the lifting platform engages the axle or other load.

The hydraulic network interconnecting the reservoir chambers 42 and 43 with the power cylinder is shown in some detail in FIGS. 4, 5, 6, and 7. The network features a first bore 80 which is in axial alignment with the power cylinder 20 and which can be made by drilling into the block 25 through the boss 55. A suitable enlargement 81 provides for a conventional spring actuated ball check 82 and a threaded adjusting plug 83.

A second bore 84 may also be formed by drilling into the block 25 in axial alignment with a threaded opening 85 in which a pump cylinder 86 is mounted. A ball check 87 is provided for the second bore 84, as shown in FIGS. 4, 5, 6, and 7 and the first bore 80 which is in communication with the second bore 84.

When the second bore 84 is to be supplied with hydraulic fluid from the chambers 42 and 43 the passage 46 serves as a supply passage communicating with a pocket 89 into which the second bore 84 extends.

A third bore 90 may be formed by drilling into the block 25 in axial alignment with a threaded opening 91 which is adapted to threadedly mount a stem 92, at the inside end of which is a valve element 93 adapted to seat upon a valve seat 94. The third bore 90 is in communication with the enlargement 81 of the first bore 80 whereby to communicate with the interior of the power cylinder. To empty the power cylinder back into the reservoir chambers 42 and 43 the passage 45 serves as a discharge passage in communication with an enlargement 96 of the third bore 90. The discharge passage 45 as noted in FIG. 8 discharges into both of the chambers 42 and 43. The supply passage 46 also communicates with it and is adapted to draw hydraulic fluid from both chambers 42 and 43. The passage 44 serves as a relief passage interconnecting the two chambers.

Figures 4, 5:
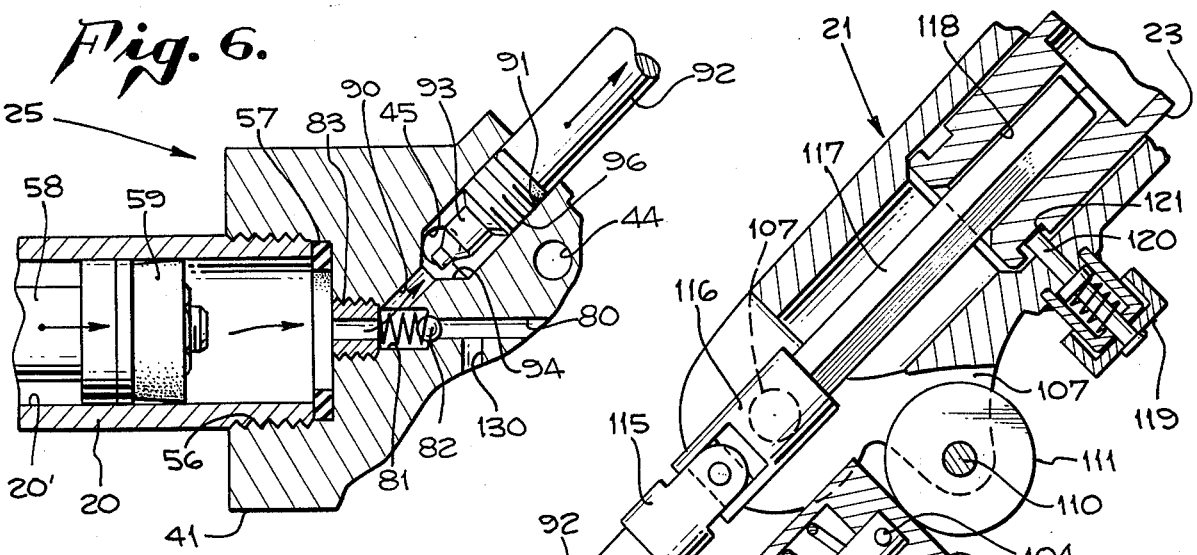
FIG. 4 is a fragmentary vertical sectional view taken on the line 4 — 4 of FIG. 2 showing the parts in position for an upstroke.
FIG. 5 is a fragmentary longitudinal sectional view similar to FIG. 4, but showing the parts in a position for a downstroke.

For details of the pump mechanism reference is made to FIGS. 4 and 5. The pump cylinder 86, previously mentioned, provides a pump chamber 100 in which is a piston 101 at the end of a piston rod 102. A drive sleeve 103 is pivotally attached by means of a pin 104 to the piston 101. The sleeve surrounds a spring 105 which bears outwardly against the interior of the sleeve and inwardly against a shoulder 106 on the pump cylinder 86, thereby to normally bias the piston 101 and the drive sleeve 103 outwardly.

For reciprocating the piston the yoke 22 previously described is pivotally mounted upon the side plates 16 and 17 by means of a pivot shaft 107. Arms 108 and 109 of the yoke support a pivot shaft 110 at a location offset with respect to the pivot shaft 107 and on the pivot shaft 110 is a roller 111. As the yoke 22 is tilted back and forth by manipulation of the extendible shaft 23 the roller 111 rolling over an end surface 112 of the drive sleeve 103 pumps the drive sleeve and the attached piston 101 in and out in a substantially conventional fashion. This action draws hydraulic fluid from the chambers 42 and 43 through the passage 46 and bore 84 past the ball check 87 during the upstroke and during the downstroke forces the hydraulic fluid through the passage 87 past the ball check 82 into the interior of the hydraulic power cylinder 20. The action moves the piston head 59 and attached ram 58 outwardly or in a direction from right to left as viewed in FIGS. 4, 5, 6, and 7.

During the pumping cycle the valve element 93 is seated upon the valve seat 94 thus closing the bore 90. Seating the valve in this fashion is accomplished by rotation of the extendible shaft 23, customarily in a clockwise or right-hand direction. To accomplish this, in any position or tilt of the extendible shaft 23 and the yoke 22, there is provided a universal joint consisting of one part 115 at the outside end of the stem 92 and another part 116 attached to a hexagonal shaft 117. The hexagonal shaft 117 is received in a hexagonal opening 118 at the lower end of the extendible shaft 23.

The extendible shaft 23 is releasably attached to the yoke 22 by employment of a substantially conventional snap lock 119, a lock pin 120 of which engages an annular recess 121 of the extendible shaft 23. The universal joint part 116 and hence the hexagonal shaft 117 rotates within the yoke 22. On the shaft is an extension 121 terminating in a hand hold 122 whereby this shaft can be lengthened in order to push the jack further under the chassis of an automobile. Another snap lock 123 can be manipulated into a hole such as the hole 124 to hold the extension in a selected adjustment nonrotatably attached to the shaft 123 so that the valve element 93 can be opened or closed at any position of the shaft.

Normally the shaft is tilted more or less at the angle suggested in FIG. 3. There is a stop lug 125 on the yoke which by engaging one or another of the upper edges 126 of the side plates limits tilting of the shaft upwardly to an angle substantially as shown in FIG. 1. The shaft may also be tilted downwardly to a position almost horizontal.

Figure 7:
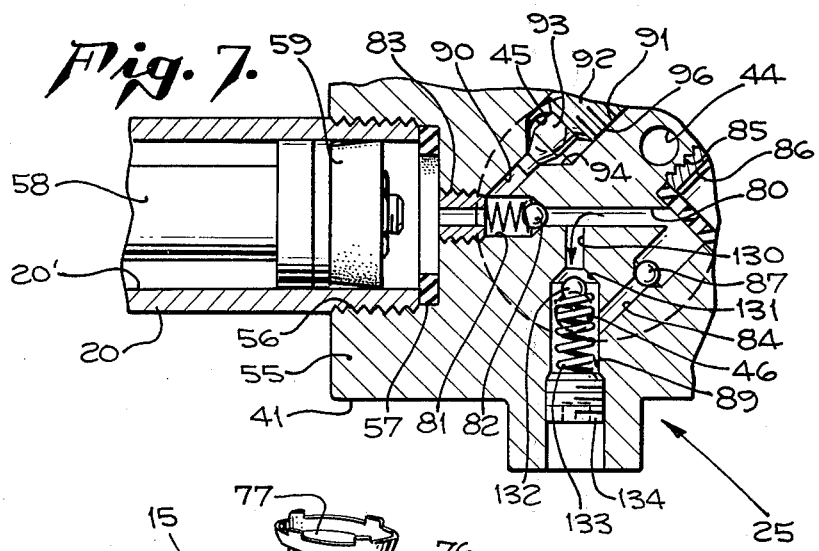
FIG. 7 is a fragmentary longitudinal sectional view showing details of the hydraulic fluid network.

In a device of this kind it is important not to overload the mechanical system and to prevent straining or breaking of such parts two factors are built into the device. As shown in FIGS. 4, 5, and 7 there is provided an overload bore 130 which is in direct communication with the first bore 80. The overload bore 130 may be formed by drilling into the block along the axis of the pocket 89 which likewise may be formed by drilling, thereby to provide a valve seat 131 against which a relief valve 132 may be seated under pressure of a spring 133. An adjusting plug 134 confined within the pocket 89 is adjustable from the bottom to set the pressure at which the relief valve 132 releases. By reason of the presence of this relief valve should the pressure of the hydraulic fluid continue to be increased after the elevator is at the top of its rise hydraulic fluid under pressure bypasses through the relief valve and returns to the reservoir through the passage 46.

An additional stop is also provided. This consists of so locating the spacer 35 that when the ram 58 pushes the trunnion 60 to a position approaching the outer end of its stroke the trunnion 60 abuts the spacer 35 and any continued pressure on the ram is absorbed by the spacer, fastened as it is to the side plates 16 and 17.

When the device to be operated the operating handle is rotated in a direction to lift the valve element 93 from the seat 94. In this condition the return spring 61 pulls the elevator to its most lower position as the ram 58 and piston head 59 are moved to substantially the position of FIGS. 4, and 5. The valve element is then seated by the extendible shaft 23 in the opposite direction and the handle is then pumped up and down to operate the pump. During the upstroke pictured in FIG. 4 hydraulic fluid from the reservoir is drawn through the second bore 84 into the pump chamber 100. During this portion of the stroke the ball check 82 is seated.

Next during the downstroke in the direction of the arrow in FIG. 5, the ball check 87 is seated and hydraulic fluid from the pump chamber 100 is forced through the first bore 80, unseating the ball check 82, and is then forced into a chamber 20' of the hydraulic power cylinder 20. As hydraulic fluid continues to be pumped into the chamber 20' by repeated movement of the extendible shaft the elevator is raised to the desired level. The elevator will stay at that level irrespective of whether or not the extendible shaft is left in a downward tilted position because of seating of the ball check 82. When the elevator is to be lowered the extendible shaft is merely rotated in a direction unseating the valve element 93 and then hydraulic fluid from the chamber 20' will pass through the third bore 90 past the valve seat 94 and then return to the reservoir through the discharge passage 45. The elevator can be lowered either rapidly or slowly by controlling the degree of opening of the valve element 93.

As has been previously noted virtually all of the bores of the hydraulic network can be drilled from the exterior of a block which can preferably be a forging. All bores and adjacent enlargements are amply recessed. Furthermore by drilling the bores in axial alignment with the other pertinences such as the power cylinder 20 the pump cylinder 86 and the stem 92 a compact arrangement of integrally mounted parts is possible. Providing the relatively heavy partition 47 centerably within the block improves the ruggedness and simplicity of construction. The drilling of the hydraulic network results in a conveniently located set of interconnecting bores which in no way diminishes the ruggedness of the block itself.

Additionally, located as shown, the hydraulic power cylinder lying between the trunnion arms 65 and 66 which are near the respective side plates permits employment of a rugged hydraulic power cylinder relatively large in diameter snuggly accommodated within the structure making it possible to provide adequate lift within a small structure. Additionally combining the manufacturing operation such as the drilling and by having parts serve a double function the total number of parts can be substantially minimized and accordingly the weight of the finished apparatus kept within reasonable bounds commensurate with the lift required.

Having described the invention what is claimed in support of Letters Patent is as follows:

1. A hydraulic lifting jack mechanism comprising a mobile frame of separate spaced horizontal parallel side plates each having inside and outside faces, a set of wheels spanning said plates at each end of the frame, transverse brace members connecting said plates, an elevating linkage pivotally supported on said frame, a hydraulic power unit on said frame and an operating handle assembly for said power unit, said power unit comprising an integral multi-purpose block having a central transverse axis, a reservoir in said block surrounding said transverse axis for hydraulic fluid, said block having parallel side walls extending uniformly around said transverse axis, circumferentially spaced anchoring elements adjacent the perimeter of each side wall of the block in positions spaced from said reservoir and anchored to the inside faces of respective said plates at a location intermediate said sets of wheels whereby the block serves simultaneously as a spacer, a parallel alignment means and a connection for said plates, said reservoir being located radially inwardly from said anchoring elements and extending transversely from one side wall to the other, a vertical inside end wall and a hydraulic power cylinder mounted on said inside end wall and supported by said block in horizontal position and operably connected to said elevating linkage, an outside end wall, a pump cylinder member mounted on said outside end wall and supported by said block and a control stem having a valve element thereon mounted on said outside end wall, a hydraulic fluid network in said block comprising a first bore in communication with said hydraulic power cylinder, a second bore in communication with said pump cylinder member and connected with said first bore and a third bore having a valve seat therein in communication with said valve element and said stem and connected to said first bore, a supply passage between the reservoir and said second bore and a discharge passage between said third bore and said reservoir at a location downstream of said valve seat.

2. A hydraulic lifting jack mechanism as in claim 1 wherein said side walls and said inside end wall of the block are substantially rectangular areas extending for the full extent of the adjacent side of said block.

3. A hydraulic lifting jack mechanism as in claim 1 wherein there is a transverse brace between said side walls of the frame being located in alignment with the hydraulic cylinder and in engagement therewith at the end of a lifting stroke whereby to provide a stop.

4. A hydraulic lifting jack mechanism as in claim 1 wherein said operating handle has a base with a pivotal mounting on said frame at a location adjacent the pump cylinder member, and a pump actuating roller on said base in operating engagement with said pump cylinder member.

5. A hydraulic lifting jack mechanism as in claim 4 wherein there is a handle extension on said base, a universal joint connecting said stem and said handle extension, and a non-rotatable connection between said handle and said stem whereby to turn said valve element on and off.

6. A hydraulic lifting jack mechanism as in claim 5 wherein said handle extension has a releasable connection respectively with said base and said stem.

7. A hydraulic lifting jack mechanism as in claim 1 wherein there is a partition across said reservoir intermediate said side walls providing a pair of spaced substantially equivalent reservoir sections on opposite sides of the partition and passages extending through said partition interconnecting said reservoir sections, said passages being in communication respectively with said bore of the hydraulic network.

8. A hydraulic lifting jack mechanism as in claim 7 wherein the hydraulic network is contained in said partition.

9. A hydraulic lifting jack mechanism as in claim 8 wherein there is an overloaded bore in communication respectively between said first bore and said reservoir, said overload bore having an overload relief valve therein including an adjustment to vary the setting.

10. A hydraulic lifting jack mechanism as in claim 8 wherein the overload bore is a hole drilled from the exterior of the block and there is an adjusting plug between the inside and outside ends.

11. A hydraulic lifting jack mechanism as in claim 8 wherein the outer end of the first bore comprises a threaded connection with said power cylinder.

12. A hydraulic lifting jack mechanism as in claim 8 wherein the outer end of the second bore comprises a threaded connection with said pump cylinder member.

13. A hydraulic lifting jack mechanism as in claim 8 wherein the outer end of said third bore comprises a threaded connection with said stem.

14. A hydraulic lifting jack mechanism as in claim 8 wherein said block has an enlarged portion intermediate opposite sides of said power cylinder, said pump cylinder member and said stem being attached to the block at said enlarged portion.

15. A hydraulic lifting jack mechanism as in claim 8 wherein said first bore has a drilled hole in axial alignment with the power cylinder, said second bore being a drilled hole in axial alignment with the pump cylinder member and said third bore being in axial alignment with the stem.

* * * * *